US012571197B2

(12) United States Patent
Hong et al.

(10) Patent No.: US 12,571,197 B2
(45) Date of Patent: Mar. 10, 2026

(54) ASSEMBLY COLUMN-BEAM CONNECTION COMPONENT

(71) Applicant: Haoheng (Fujian) Building Materials Technology Co., Ltd., Zhangzhou (CN)

(72) Inventors: Yuchen Hong, Zhangzhou (CN); Qiuyao Hong, Zhangzhou (CN)

(73) Assignee: Haoheng (Fujian) Building Materials Technology Co., Ltd., Zhangzhou (CN)

( * ) Notice: Subject to any disclaimer, the term of this patent is extended or adjusted under 35 U.S.C. 154(b) by 224 days.

(21) Appl. No.: 18/495,695

(22) Filed: Oct. 26, 2023

(65) Prior Publication Data

US 2024/0068224 A1 Feb. 29, 2024

(51) Int. Cl.
*E04B 1/24* (2006.01)

(52) U.S. Cl.
CPC .... *E04B 1/2403* (2013.01); *E04B 2001/2418* (2013.01); *E04B 2001/2421* (2013.01); *E04B 2001/2454* (2013.01)

(58) Field of Classification Search
CPC ..... E04B 1/2403; E04B 2001/2418; E04B 2001/2421; E04B 2001/2454; E04B 1/5831; E04B 2001/2451; E04B 2001/2469; E04B 2001/5856
See application file for complete search history.

(56) References Cited

U.S. PATENT DOCUMENTS

| | | | | |
|---|---|---|---|---|
| 10,858,819 | B2 * | 12/2020 | Styrc | E04B 1/0046 |
| 12,338,618 | B2 * | 6/2025 | Wang | E04B 1/2608 |
| 2005/0084324 | A1 * | 4/2005 | Dubensky | E04B 1/3483 403/305 |
| 2018/0238041 | A1 * | 8/2018 | Styrc | E04B 1/2608 |
| 2019/0376272 | A1 * | 12/2019 | Styrc | A45F 3/24 |
| 2024/0141637 | A1 * | 5/2024 | Hong | E04B 1/5825 |
| 2024/0295113 | A1 * | 9/2024 | Wang | E04B 1/2608 |

FOREIGN PATENT DOCUMENTS

| | | | | |
|---|---|---|---|---|
| CN | 114250860 | A | 3/2022 | |
| EP | 4361366 | B1 * | 8/2024 | E04B 1/5825 |

* cited by examiner

*Primary Examiner* — Rodney Mintz

(57) ABSTRACT

An assembly column-beam connection component includes a vertically-oriented connecting body for connecting to columns and a horizontally-oriented connecting body for connecting to beams. One end of the horizontally-oriented connecting body is connected to the vertically-oriented connecting body. The vertically-oriented connecting body includes sequentially arranged front sidewall, left sidewall, rear sidewall, and right sidewall. Each of these sidewalls features concave portions extending along the vertically-oriented connecting body's length in the vertical direction. The concave portions on the left sidewall and rear sidewall are positioned near the junction of the left sidewall and rear sidewall, while those on the front sidewall and right sidewall are situated at their respective centers. Multiple installation through-holes for connecting to columns are provided on the various sidewalls of at least one end of the vertically-oriented connecting body.

7 Claims, 4 Drawing Sheets

ASSEMBLY COLUMN-BEAM CONNECTION COMPONENT

FIELD OF THE INVENTION

The present invention relates to the field of construction materials technology, especially to an assembly column-beam connection component.

BACKGROUND OF THE INVENTION

With the maturation of technology, prefabricated construction has begun to emerge and has garnered widespread attention in the construction industry. Prefabricated construction refers to buildings assembled on-site using prefabricated components. The advantages of this type of construction include rapid construction, minimal susceptibility to weather conditions, labor savings, and improved construction quality.

The inventor disclosed a patent in a previously filed Chinese patent application, published as CN114250860A, for an invention patent that reveals a connection unit for prefabricated construction. This unit comprises a first tubular body, a second tubular body, and a connector for joining the first and second tubular bodies. The connector has multiple installation through-holes at both ends, and the first and second tubular bodies each feature multiple corresponding connecting apertures. The connector's ends are embedded within the first and second tubular bodies, aligning the installation through-holes with the connecting apertures. A bolt assembly sequentially passes through the connecting apertures on the first and second tubular bodies and the installation through-holes on the connector, thereby connecting the connector to the first and second tubular bodies.

However, the aforementioned patent has the following shortcomings: firstly, it can only achieve vertical component connections, and secondly, it exhibits relatively poor structural stability at the connection points.

SUMMARY OF THE INVENTION

The object of the present invention is to provide an assembly column-beam connection component. This assembly column-beam connection component enhances the structural strength and stability of the vertical connection between the overall vertical structure and the external vertical components when connecting to the front and right sidewalls and horizontal components externally.

To achieve the above object, the technical solution employed in the present invention is as follows: an assembly column-beam connection component includes a vertically-oriented connecting body for connecting to columns and a horizontally-oriented connecting body for connecting to beams. One end of the horizontally-oriented connecting body is connected to the vertically-oriented connecting body. The vertically-oriented connecting body includes a front sidewall, a left sidewall, a rear sidewall, and a right sidewall arranged in sequence. The left sidewall and rear sidewall have the same width, while the front sidewall and right sidewall have the same width, which is smaller than that of the left and rear sidewalls. The front sidewall connected to the left sidewall and the right sidewall connected to the rear sidewall are joined by a right-angled wall plate which is bent inward. Two horizontally-oriented connecting bodies are individually connected to the front sidewall or the right sidewall.

Each of the sidewalls is equipped with an inward concave portion extending along the length of the vertically-oriented connecting body in the vertical direction. The inward concave portions on the left and rear sidewalls are located near the junction of the left sidewall and rear sidewall, while the inward concave portions on the front and right sidewalls are positioned in their respective centers. Multiple installation through-holes for connecting to columns are provided on the various sidewalls of at least one end of the vertically-oriented connecting body, and they are located within the inward concave portions.

The improved aspects of the above technical solution are as follows:

In some embodiments, the inward concave portions are distributed along the length of the vertically-oriented connecting body.

In some embodiments, the horizontally-oriented connecting body is connected to the front sidewall or right sidewall of the vertically-oriented connecting body by welding.

In some embodiments, the horizontally-oriented connecting body can be any one of a steel pipe connector, an I-beam connector, or a C-channel connector.

In some embodiments, the installation through-holes are located at one end of the vertically-oriented connecting body, and the other end of the vertically-oriented connecting body has a horizontally-oriented connecting body connected to its front sidewall and right sidewall.

In some embodiments, two horizontally-oriented connecting bodies are connected in the middle region of the front sidewall and right sidewall of the vertically-oriented connecting body, and installation through-holes are provided at both ends of the vertically-oriented connecting body.

In some embodiments, the vertically-oriented connecting body with front sidewall, left sidewall, rear sidewall, and right sidewall is obtained through integral molding.

Through the application of the aforementioned technical solution, the present invention exhibits the following advantages when compared to existing technology:

The assembly column-beam connection component of the present invention achieves simultaneous connection of horizontal and vertical components. The vertically-oriented connecting body used for column connection includes sequentially arranged front sidewall, left sidewall, rear sidewall, and right sidewall. The connected left sidewall and rear sidewall have the same width, while the front sidewall and right sidewall have the same width, which is smaller than that of the left and rear sidewalls. The front sidewall connected to the left sidewall and the right sidewall connected to the rear sidewall are joined by an inwardly bent right-angled wall plate. Two horizontally-oriented connecting bodies are each connected to the front sidewall or right sidewall. Each sidewall features a concave portion extending along the length of the vertically-oriented connecting body in the vertical direction. The concave portions on the left and rear sidewalls are located near the junction of the left sidewall and rear sidewall. This design enhances the structural strength of the vertically-oriented connecting body itself and prevents positional misalignment between interconnected components when connecting to external vertical components with installation through-holes. This, in turn, improves stability and structural strength. Furthermore, when connecting to external vertical components, the concave portions provide an embedded region for the bolt heads, ensuring the flatness and smoothness of the external facade of the connection structure. This facilitates subsequent decorative construction. When connecting to external horizontal components on the front and right sidewalls, it further enhances the structural strength and stability of the overall connection between the vertically-oriented connecting body and the external vertical components.

Figure 1:
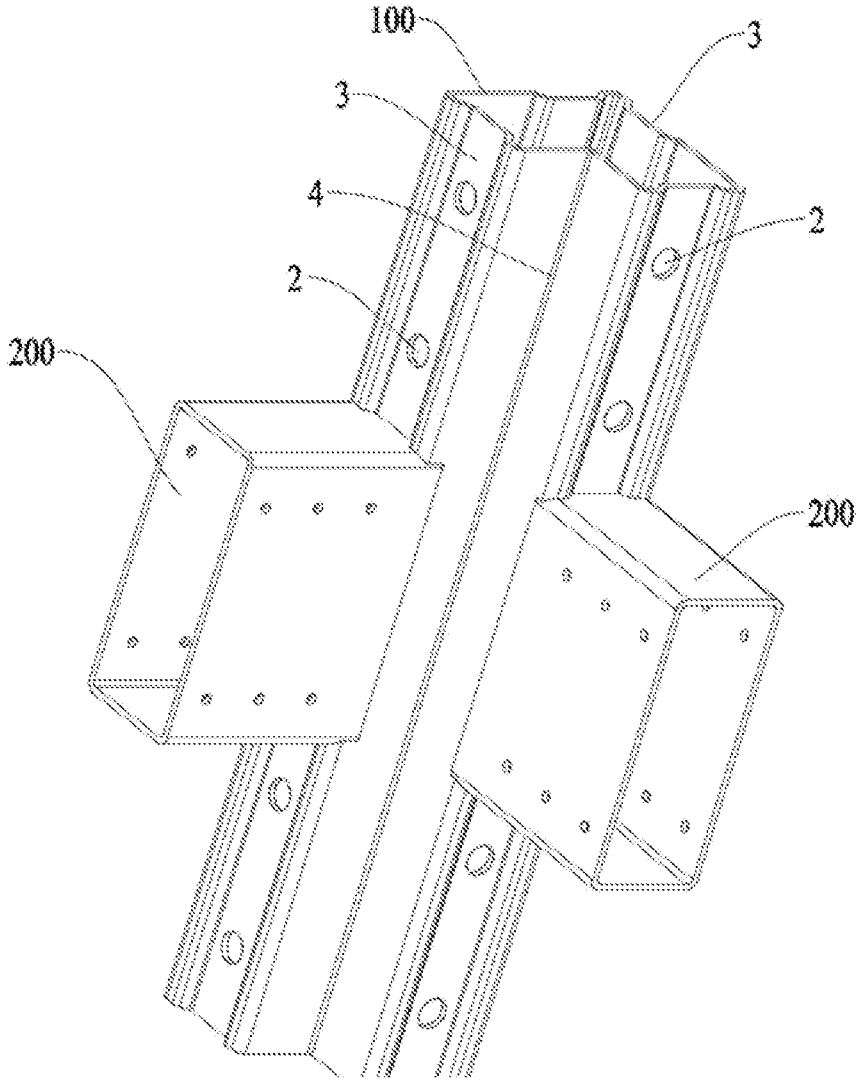
FIG. 1 shows a schematic diagram of the assembly column-beam connection component according to one embodiment in the present invention.
Figure 2:
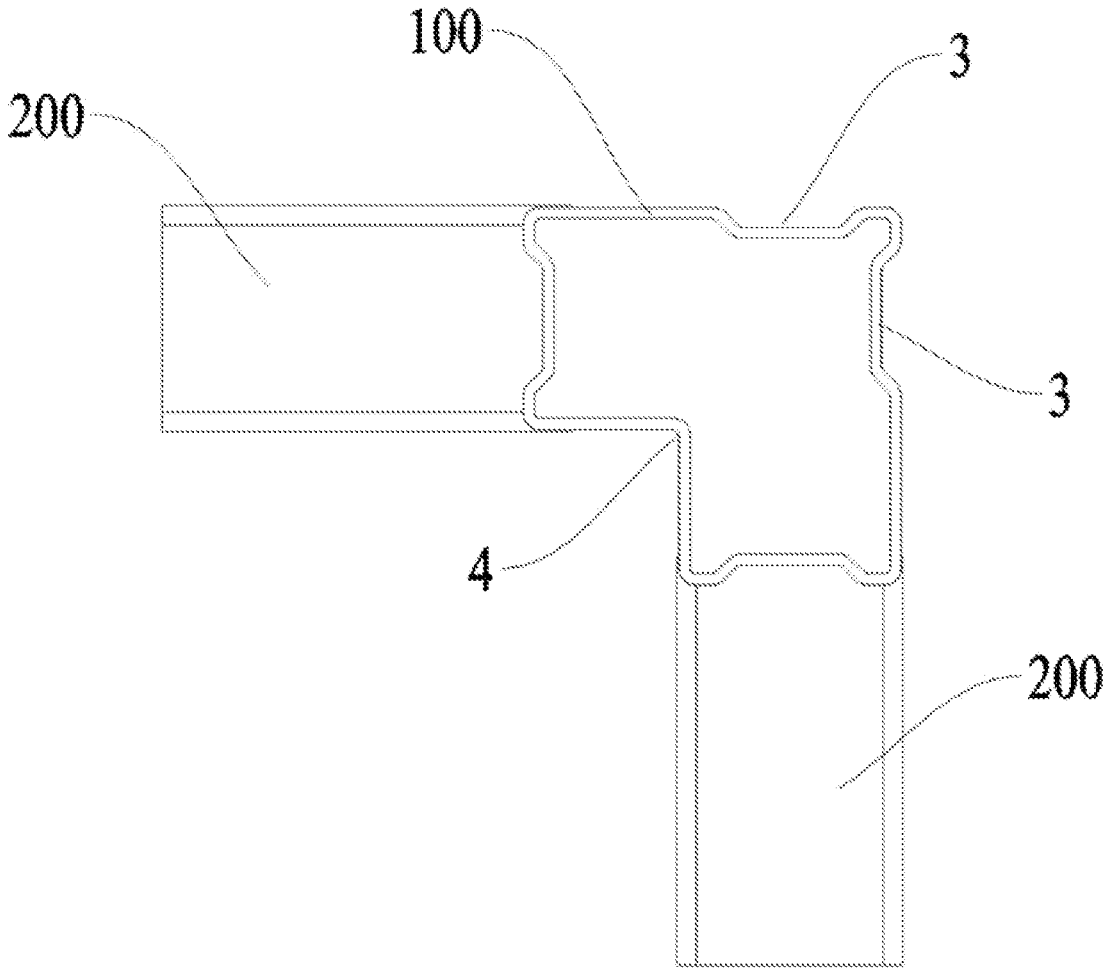
FIG. 2 shows a top view of the assembly column-beam connection component according to one embodiment in the present invention.
Figure 3:
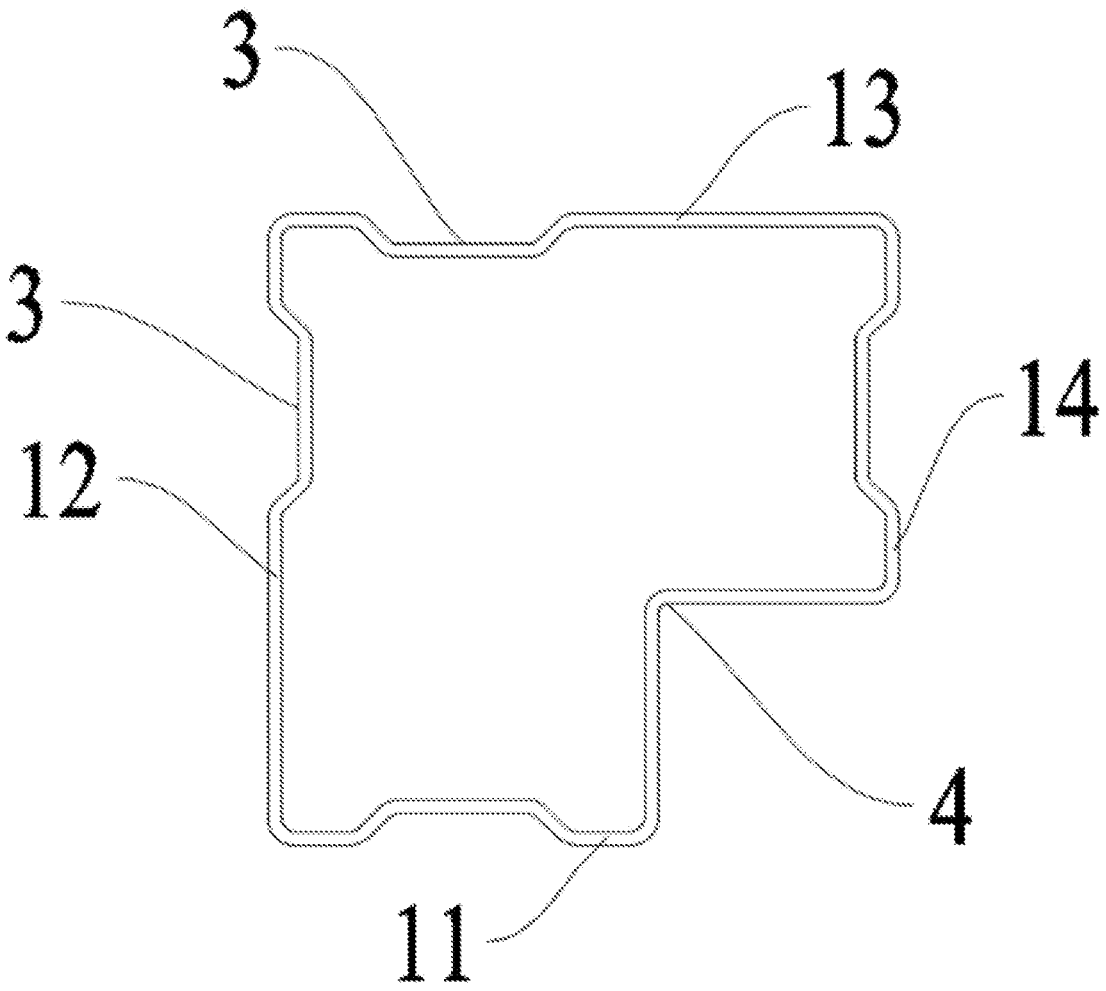
FIG. 3 shows a partially-enlarged view of the assembly column-beam connection component of FIG. 2.

In the drawings: 100, vertically-oriented connecting body; 200, horizontally-oriented connecting body; 11, front sidewall; 12, left sidewall; 13, rear sidewall; 14, right sidewall; 2, installation through-holes; 3, inward concave portion; 4, right-angled wall plate.

DETAILED DESCRIPTION OF THE INVENTION

Embodiment 1

As shown in FIGS. 1-4, an assembly column-beam connection component, includes a vertically-oriented connecting body 100 for connecting to columns and a horizontally-oriented connecting body 200 for connecting to beams. One end of the horizontally-oriented connecting body 200 is connected to the vertically-oriented connecting body 100. The vertically-oriented connecting body 100 further includes sequentially arranged front sidewall 11, left sidewall 12, rear sidewall 13, and right sidewall 14. The connected left sidewall 12 and rear sidewall 13 have the same width, while the front sidewall 11 and right sidewall 14 have the same width, which is smaller than that of the left sidewall 12 and rear sidewall 13. The front sidewall 11 connected to the left sidewall 12 and the right sidewall 14 connected to the rear sidewall 13 are joined by an inwardly bent right-angled wall plate 4. Two horizontally-oriented connecting bodies 200 are each connected to the front sidewall 11 or right sidewall 14.

Each of the sidewalls is equipped with a concave portion 3 extending along the length of the vertically-oriented connecting body 100 in the vertical direction. The concave portions 3 on the left sidewall 12 and rear sidewall 13 are positioned near the junction of the left sidewall 12 and rear sidewall 13. The concave portions 3 on the front sidewall 11 and right sidewall 14 are situated at their respective centers. Multiple installation through-holes 2 for connecting to columns are provided on the various sidewalls of at least one end of the vertically-oriented connecting body 100 and are located within the concave portions 3.

The concave portions 3 are distributed along the entire length of the vertically-oriented connecting body 100.

The horizontally-oriented connecting body 200 is welded to the front sidewall 11 or right sidewall 14 of the vertically-oriented connecting body 100. The horizontally-oriented connecting body 200 is a C-channel connector.

The installation through-holes 2 are located at one end of the vertically-oriented connecting body 100, and the other end of the vertically-oriented connecting body 100 has a horizontally-oriented connecting body 200 connected to its front sidewall 11 and right sidewall 14.

Embodiment 2

As shown in FIGS. 1-4, an assembly column-beam connection component, comprising a vertically-oriented connecting body 100 for connecting to columns and a horizontally-oriented connecting body 200 for connecting to beams. One end of the horizontally-oriented connecting body 200 is connected to the vertically-oriented connecting body 100. The vertically-oriented connecting body 100 further includes sequentially arranged front sidewall 11, left sidewall 12, rear sidewall 13, and right sidewall 14. The connected left sidewall 12 and rear sidewall 13 have the same width, while the front sidewall 11 and right sidewall 14 have the same width, which is smaller than that of the left sidewall 12 and rear sidewall 13. The front sidewall 11 connected to the left sidewall 12 and the right sidewall 14 connected to the rear sidewall 13 are joined by an inwardly bent right-angled wall plate 4. Two horizontally-oriented connecting bodies 200 are each connected to the front sidewall 11 or right sidewall 14.

Each of the sidewalls is equipped with a concave portion 3 extending along the length of the vertically-oriented connecting body 100 in the vertical direction. The concave portions 3 on the left sidewall 12 and rear sidewall 13 are positioned near the junction of the left sidewall 12 and rear sidewall 13. The concave portions 3 on the front sidewall 11 and right sidewall 14 are situated at their respective centers. Multiple installation through-holes 2 for connecting to columns are provided on the various sidewalls of at least one end of the vertically-oriented connecting body 100 and are located within the concave portions 3.

The horizontally-oriented connecting body 200 is a steel pipe connecting body, and the vertically-oriented connecting body 100 with front sidewall 11, left sidewall 12, rear sidewall 13, and right sidewall 14 is obtained through integral molding.

Two of the horizontally-oriented connecting bodies 200 are each connected in the middle region of the front sidewall 11 and right sidewall 14 of the vertically-oriented connecting body 100, and installation through-holes 2 are provided at both ends of the vertically-oriented connecting body 100.

Figure 4:
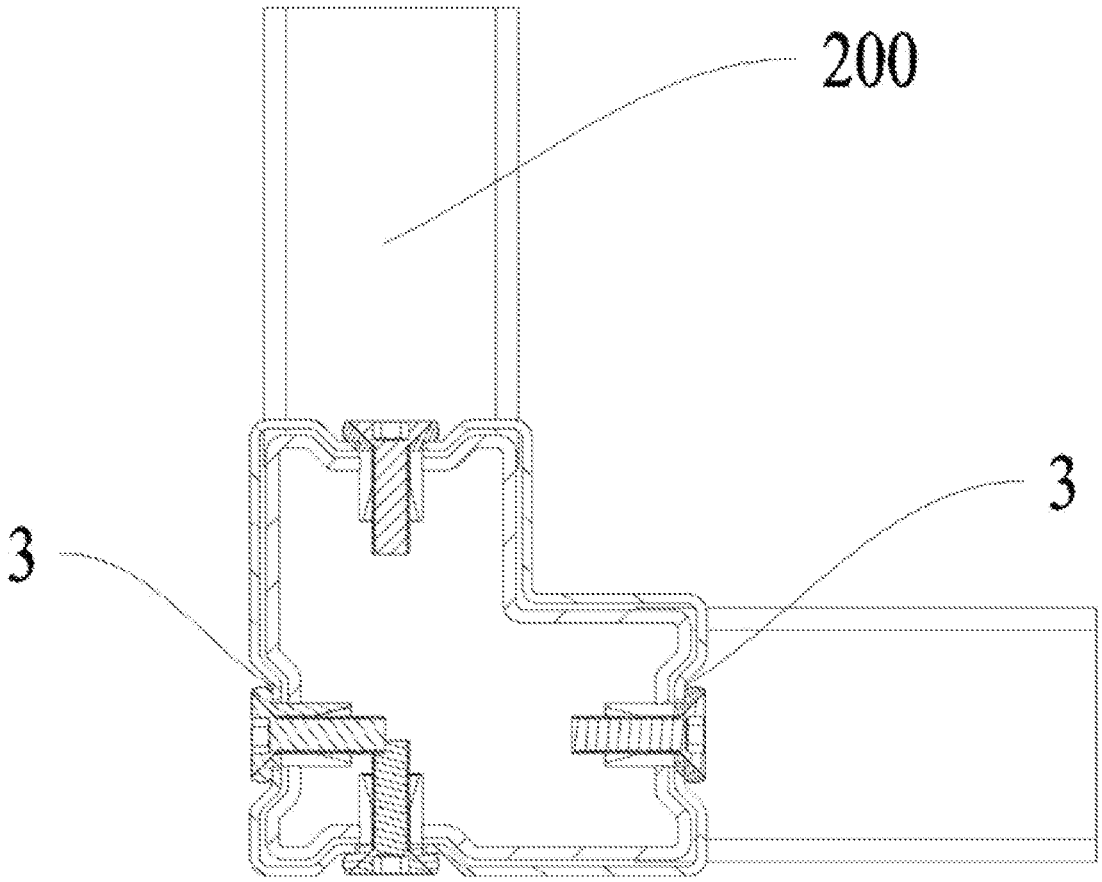
FIG. 4 shows a cross-sectional view of the assembly column-beam connection component in its operational state according to one embodiment in the present invention.

As shown in FIG. 4, when the vertically-oriented connecting body 100 is connected to the corresponding external vertical components using bolts or expansion screws passing through the installation through-holes, the concave portion precisely provides an embeddable area for the bolt head, avoiding protrusion that may affect aesthetics. This also facilitates subsequent decorative and finishing work.

By using the above assembly column-beam connection component, it achieves simultaneous connection of horizontal and vertical components and provides structural strength and stability. The vertically-oriented connecting body for column connection comprises sequentially arranged front sidewall, left sidewall, rear sidewall, and right sidewall. The left sidewall and rear sidewall have the same width, and the front sidewall and right sidewall have the same width, which is smaller than that of the left sidewall and rear sidewall. The front sidewall connected to the left sidewall and the right sidewall connected to the rear sidewall are joined by an inwardly bent right-angled wall plate. Two horizontally-oriented connecting bodies are each connected to the front sidewall or right sidewall. Each sidewall features a concave portion extending along the length of the vertically-oriented connecting body in the vertical direction. The concave portions enhance the structural strength of the vertically-oriented connecting body itself, prevent positional misalignment between interconnected components when connecting to external vertical components with installation through-holes, and improve stability and structural strength. Furthermore, when connecting to external vertical components, the concave portion provides an embedded area for the bolt heads, ensuring the flatness and smoothness of the external facade of the connection structure, facilitating subsequent decorative construction on the front and right sidewalls with external horizontal components.

The above examples are provided solely to illustrate the technical concept and characteristics of the present invention, with the intention to enable those skilled in this art to understand the content of the present invention and implement it. These examples should not be construed as limiting the scope of protection of the present invention. Any equivalent changes or modifications made in accordance with the essence of the present invention are encompassed within the scope of protection of the present invention.

What is claimed is:

1. An assembly column-beam connection component, comprising:

a vertically-oriented connecting body (100) configured to connect to columns and a horizontally-oriented connecting body (200) configured to connect to beams; one end of the horizontally-oriented connecting body (200) is connected to the vertically-oriented connecting body (100);

the vertically-oriented connecting body (100) comprises sequentially arranged front sidewall (11), left sidewall (12), rear sidewall (13), and right sidewall (14);

the left sidewall (12) and rear sidewall (13) have a first, equal width, while the front sidewall (11) and right sidewall (14) have a second, equal width, which is smaller than that of the left sidewall (12) and rear sidewall (13);

the front sidewall (11) connected to the left sidewall (12) and the right sidewall (14) connected to the rear sidewall (13) are joined by an inwardly bent right-angled wall plate (4);

two horizontally-oriented connecting bodies (200) are each connected to the front sidewall (11) or right sidewall (14); each of the sidewalls is equipped with inward concave portions (3) extending along a length of the vertically-oriented connecting body (100) in a vertical direction; the concave portions (3) on the left sidewall (12) and rear sidewall (13) are positioned proximate a junction of the left sidewall (12) and rear sidewall (13); the concave portions (3) on the front sidewall (11) and right sidewall (14) are situated at respective centers thereof; a plurality of installation through-holes (2) configured to connect to the columns are provided on the sidewalls of at least one end of the vertically-oriented connecting body (100).

2. The assembly column-beam connection component according to claim 1, wherein the concave portions (3) are distributed along an entire length of the vertically-oriented connecting body (100).

3. The assembly column-beam connection component according to claim 1, wherein the horizontally-oriented connecting body (200) is connected to the front sidewall (11) or right sidewall (14) of the vertically-oriented connecting body (100) through welding.

4. The assembly column-beam connection component according to claim 1, wherein the horizontally-oriented connecting body (200) is selected from a group consisting of a steel pipe connector, an I-beam connector, and a C-channel connector.

5. The assembly column-beam connection component according to claim 1, wherein the installation through-holes (2) are located at the one end of the vertically-oriented connecting body (100), and an opposite end of the vertically-oriented connecting body (100) has a horizontally-oriented connecting body (200) connected to a respective said front sidewall (11) and right sidewall (14).

6. The assembly column-beam connection component according to claim 1, wherein two of the horizontally-oriented connecting bodies (200) are each connected in a middle region of the front sidewall (11) and right sidewall (14) of the vertically-oriented connecting body (100), and the installation through-holes (2) are provided at both ends of the vertically-oriented connecting body (100).

7. The assembly column-beam connection component according to claim 1, wherein the vertically-oriented connecting body (100) with the front sidewall (11), the left sidewall (12), the rear sidewall (13), and the right sidewall (14) is formed through integral molding.

* * * * *